US006404310B1

(12) United States Patent
Ando et al.

(10) Patent No.: US 6,404,310 B1
(45) Date of Patent: Jun. 11, 2002

(54) MAGNET SWITCH HAVING METAL-MOLDED RESINOUS SWITCH COVER

(75) Inventors: Kazuhiro Ando, Okazaki; Masahiro Kato, Chiryu; Yasuyuki Wakahara, Kariya, all of (JP)

(73) Assignee: Denso Corporation, Kariya (JP)

( * ) Notice: Subject to any disclaimer, the term of this patent is extended or adjusted under 35 U.S.C. 154(b) by 22 days.

(21) Appl. No.: 09/716,453

(22) Filed: Nov. 21, 2000

(30) Foreign Application Priority Data

Nov. 24, 1999 (JP) ..... 11-332251

(51) Int. Cl.[7] ..... H01H 63/02; H01H 67/02

(52) U.S. Cl. ..... 335/133; 335/131

(58) Field of Search ..... 335/126, 127, 335/131, 132, 133, 196, 202; 336/192; 200/284

(56) References Cited

U.S. PATENT DOCUMENTS 5,521,566 A * 5/1996 Krubsack et al. ..... 335/126
5,812,041 A * 9/1998 Ishikawa et al. ..... 200/284

* cited by examiner

*Primary Examiner*—Ramon M. Barrera
(74) *Attorney, Agent, or Firm*—Oliff & Berridge, PLC

(57) ABSTRACT

A magnet switch includes a resinous switch cover and an external terminal. The switch cover has a cylindrical metal member insert-molded into a fixing portion, and the external terminal is disposed inside the metal member. The external terminal has an anchoring head having a first sealing surface at one end and a screw portion extending to the other end that protrudes from the switch cover. A nut is screwed to the screw portion at the other end so as to generate an axial force between the nut and the anchoring head, thereby fixing the external terminal. The switch cover has a second sealing surface opposite the first sealing portion, and a seal member is disposed in a gap between the first and second sealing surfaces to seal the gap.

4 Claims, 3 Drawing Sheets

MAGNET SWITCH HAVING METAL-MOLDED RESINOUS SWITCH COVER

CROSS REFERENCE TO RELATED APPLICATION

The present application is based on and claims priority from Japanese Patent Application Hei 11-332251 filed Nov. 24, 1999, the contents of which are incorporated herein by reference.

BACKGROUND OF THE INVENTION

1. Field of the Invention

The present invention relates to a magnet switch having a resinous switch cover and a metal member that is insert-molded into the switch cover.

2. Description of the Related Art

JP-A-11-213087 discloses a conventional magnet switch. The magnet switch includes a resinous case, a cylindrical metal member fixed to the resinous case, an external terminal comprised of a bolt inserted into the inside of the metal member, and a nut screwed to external terminal. The metal member is designed to receive the fastening force of nut.

When a creep appears due to natural aging process in the resinous case of such a magnet switch as includes the metal member insert-molded into the resinous case, cracks form around the metal member, and the sealing performance of the resinous case deteriorates. Particularly, such cracks may form in the magnet switch of a starter under a high temperature caused by a large amount of electric current flowing through the magnet switch. Therefore, the sealing performance of the portion around the external terminal is very important.

In the above-described magnet switch, two O-rings are respectively inserted into gaps between the metal member and the external terminal and between the metal member and the resinous case so that the gaps inside and outside of metal member can be sealed. However, the above sealing structure necessarily increases the number of parts and becomes complicated. This also increases the cost of the magnet switch.

SUMMARY OF THE INVENTION

The invention has been made in view of the above circumstances. The object of the invention is to provide an inexpensive magnet switch having a simple sealing structure around the external terminal.

Features of the present invention are as follows:

a head of the external terminal has a first sealing surface; a switch cover has a second sealing surface opposite the first sealing surface; and a seal member is disposed in a gap between the first and second sealing surfaces to seal the gap.

According to the above feature, only a single sealing member is necessary, so that the sealing structure can be made simple, and the number of parts can be reduced. Therefore, such a magnet switch can be manufactured at a low cost.

Preferably, the head of the external terminal has a first perpendicular surface that is approximately perpendicular to the axial direction of the terminal at a side facing the screw portion. The switch cover has a second annular perpendicular surface facing the first perpendicular surface of the head; and a seal member is disposed in the gap between the first and second perpendicular surfaces to seal the gap.

In the above magnet switch, it is preferable to provide the following features: the head of the external terminal includes a rotation stopper portion having a polygonal outer periphery and a cylindrical portion having a cylindrical outer periphery; and the cylindrical portion is formed stepwise at a side of the rotation stopper portion facing the screw portion.

In the above magnet switch, it is more preferable to provide the following feature: the outer periphery of the metal member insert-molded into the switch cover has a corrugated surface in the longitudinal direction. It is possible to provide a long boundary between the metal member and the switch cover to improve the sealing performance. The corrugated surface can fix the metal member to the switch cover effectively.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
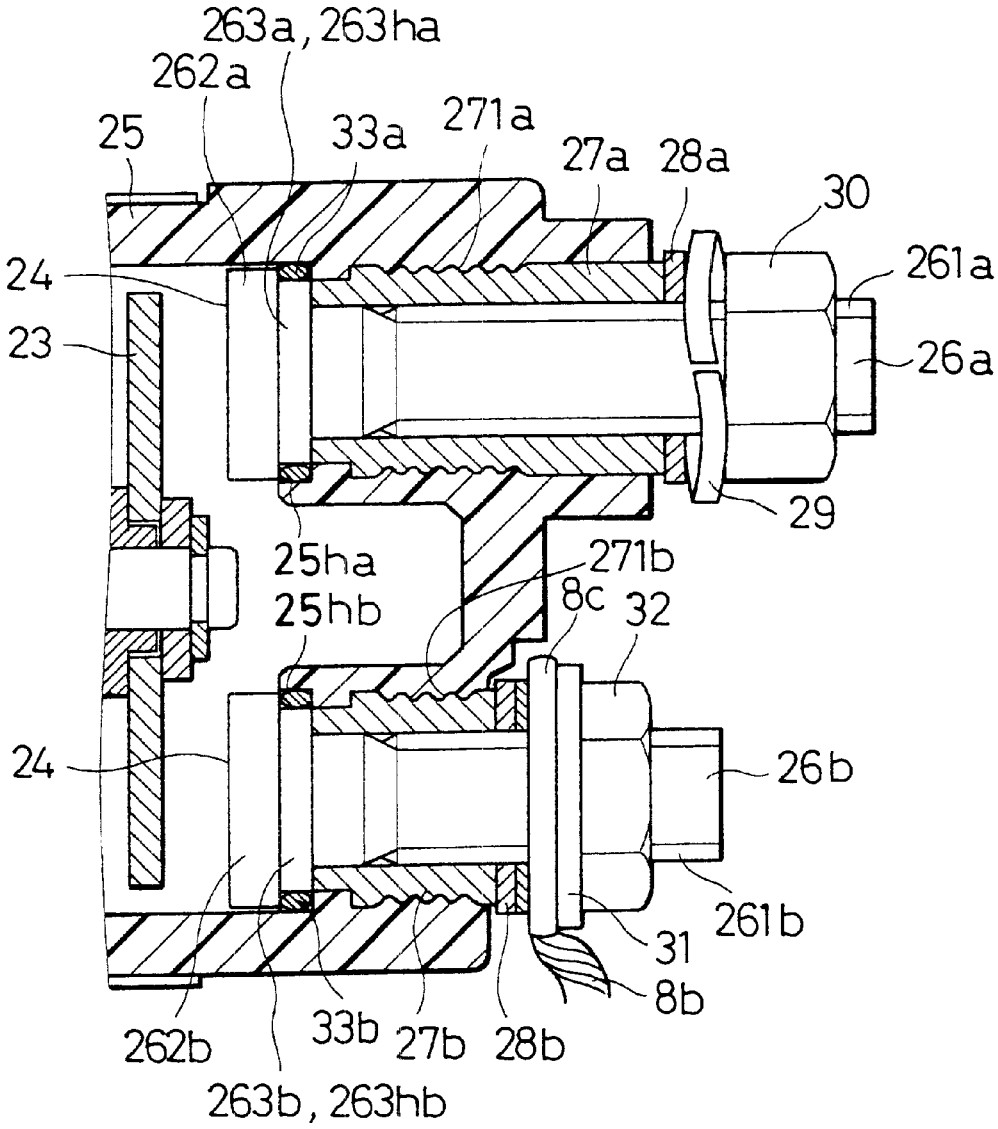
FIG. 1 is a cross-sectional side view illustrating a seal structure around an external terminal of a magnet switch according to a first embodiment of the invention.

A magnet switch according to a first embodiment of the invention is described with reference to FIGS. 1–3.

Starter 1 is comprised of starting motor 2, a speed reduction unit, a shock absorber, one-way clutch 5, magnet switch 6, and etc. Starting motor 2 generates starting torque of an engine. The speed reduction unit reduces the rotation speed and transmits the reduced speed to output shaft 3. The shock absorber absorbs an excessive torque applied to the speed reduction unit. One-way clutch 5 transmits the rotation of output shaft 3 to pinion gear 4, and magnet switch 6 is disposed in parallel with starting motor 2.

Starting motor 2 is a well-known DC motor comprised of armature 7, stationary poles 8, yoke 9, and brush unit 10. Armature 7 rotates when a key switch (not shown) is turned on to close a pair of internal contacts of magnet switch 6 to supply electric power to armature 7 via brush unit 10.

Figure 3:
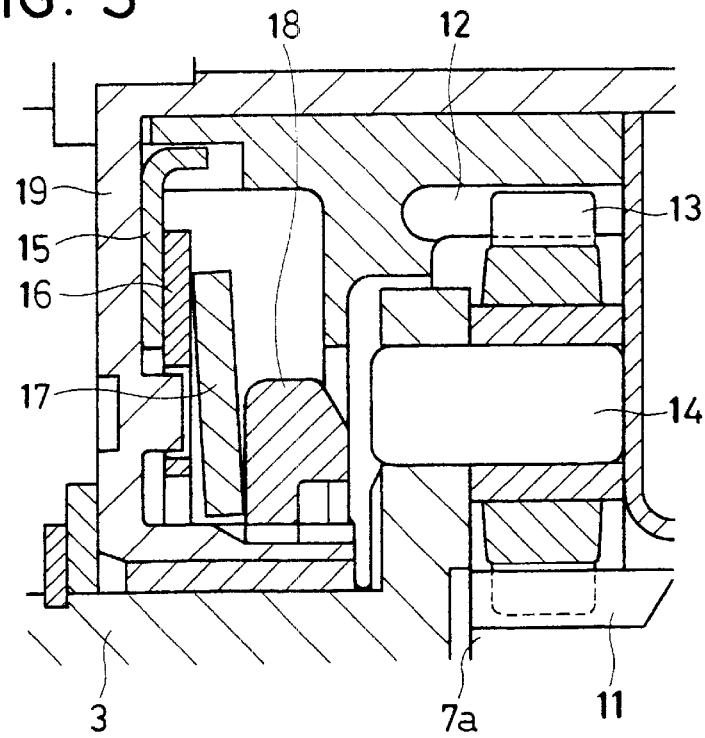
FIG. 3 is a fragmentary enlarged cross-sectional view illustrating a speed reduction unit and a shock absorber mounted in the starter shown in FIG. 2.

The speed reduction unit, as shown in FIG. 3, is comprised of sun gear 11 having outer teeth around armature shaft 7*a*, ring-shaped internal gear 12 having inner teeth around sun gear 11, planetary gear 13 disposed between sun gear 11 and internal gear 12 to mesh with the two members. When planetary gear 13 rotates on its axis and revolves around sun gear 11, the revolution of planetary gear 13 is transmitted to output shaft 3 via pin 14.

The shock absorber, as shown in FIG. 3, is comprised of rotary disk 15, stationary disk 16, dish spring 17 that biases stationary disk 16 against rotary disk 15, adjust screw 18 that adjusts the initial spring force of dish spring 17.

Rotary disk 15 is a friction plate that has a rough or bumpy surface. Rotary disk 15 is sandwiched between center case 19 and stationary disk 16 and is anchored to internal gear 12 to be prevented from turning. Stationary disk 16 is disposed to be in close contact with rotary disk 15 and is also anchored to center case 19 to be prevented from turning.

One-way clutch 5 is jointed to the outer periphery of output shaft 3 by means of a helical spline so that it can longitudinally slide along output shaft 3 together with pinion gear 4. Thus, the rotation of output shaft 3 is transmitted to pinion gear 4. When an engine starts and the rotation speed of pinion gear 4 becomes higher than the speed of output shaft 3, transmission of torque between output shaft 3 and pinion gear 4 is stopped.

Pinion gear 4 is slidably fitted to the outer periphery of output shaft 3 via bearing 20 so that it can move along output shaft 3 to engage ring gear 21 of the engine, thereby transmitting the torque to ring gear 21.

Magnet switch 6 opens or closes the pair of internal contacts and makes lever 22 move pinion gear 4 together with one-way clutch 5 back and forth in response to reciprocating motion of a built-in plunger (not shown).

The pair of internal contacts is comprised of movable contact 23 fixed to the plunger and stationary contact 24 fixed to external terminals 26*a* and 26*b*, each of which is fixed to switch cover 25 of magnet switch 6.

Switch cover 25 is made of a resinous material and covers the rear portion of magnet switch 6. Switch cover 25 has cylindrical metal members 27*a* and 27*b*, each of which is insert-molded into terminal-fixing portions. Cylindrical member 27*a* and 27*b* are disposed to be approximately perpendicular to the outer or right end of switch cover 25. The axially inner end (or left end in FIG. 1) of cylindrical members 27*a* and 27*b* is approximately level with the axially inner end (or left end) of the circumferential portion of the cover 25. On the other hand, the axially outer end (or right end) of cylindrical members 27*a* and 27*b* projects slightly from the axially outer end (or right end) of the circumferential portion of the cover 25. The outer periphery of each of cylindrical members 27*a* and 27*b* has longitudinally extending (right and left) corrugation 271.

External terminal 26*a* is a B-terminal to be connected to a battery cable, and terminal 26*b* is a C-terminal to be connected to lead 8*b* of field coil 8*a* (shown in FIG. 2) of starting motor 2. Each of external terminals 26*a* and 26*b* is formed of a bolt that has screw portion 261*a* or 261*b*, head portion 262*a* or 262*b* and cylindrical neck portion 263*a* or 263*b*. A pair of stationary contacts 24*a* and 24*b* is formed at the axially inner end of head portions 262*a* and 262*b*.

Screw portions 261*a* and 261*b* are respectively inserted to the inside of cylindrical member 27*a* and 27*b* from the inside or left side of switch cover 25 until screw portions 26*a* and 26*b* protrude outward from switch cover 25. Thereafter, cup-shaped washers 28*a* and 28*b* are fitted to screw portion 261*a* and 261*b*. Cylindrical members 27*a* receives the fastening force of cup-shaped washers 28*a* at the portion between head portion 262*a* and cup-shaped washer 28*a*, and cylindrical members 27*b* receives the fastening force of cup-shaped washers 28*b* at the portion between head portion 262*b* and cup-shaped washer 28*b*.

A terminal (not shown) of the battery cable is fitted to screw portion 261*a* of terminal 26*a* and fastened by nut 30.

Terminal 8*c* of lead wire 8*b* along with washer 31 is fitted to screw portion 261*b* of terminal 26*b*, and nut 32 is screwed to screw portion 261*b* so that lead wire 8*b* of field coil 8*a* is fixed by nut 32 via washer 31 (as shown in FIG. 1).

Head portion 262*a* of external terminal 26*a* is polygonal (e.g. hexagonal or rectangular) anchor portion, and cylindrical neck portion 263*a* is formed stepwise at the right side of head portion 262*a* near screw portion 261*a*. Head portion 262*b* of external terminal 26*b* is also a polygonal anchor portion, and cylindrical neck portion 263*b* is formed stepwise at the right side of head portion 262*b* near screw portion 261*b*.

Each of head portions 262*a* and 262*b* has at least a side anchored to an inner wall of switch cover 25 to prevent external terminal 26*a* or 26*b* from rotating when nut 30 or 32 is screwed to screw portion 261*a* or 261*b*.

Each of cylindrical neck portions 263*a* and 263*b* has an outside diameter that is smaller than the diameter of the inscribed circle of head portion 262*a* or 262*b* and approximately equal to the outside diameter of the inner end of cylindrical member 27*a* or 27*b*. O-rings 33*a* and 33*b* are respectively fitted to the outer peripheries of cylindrical neck portions 263*a* and 263*b*.

O-ring 33*a* is compressed between cylindrical inner surface 25*ha* of switch cover 25 and an annular outer surface 263*ha* of neck portion 263*a*. O-ring 33*b* is also compressed between cylindrical inner surface 25*hb* of switch cover 25 and an annular outer surface 263*hb* of neck portion 263*b*. O-rings 33*a* and 33*b* are a well-known O-shaped sealing rubber ring.

Figure 2:
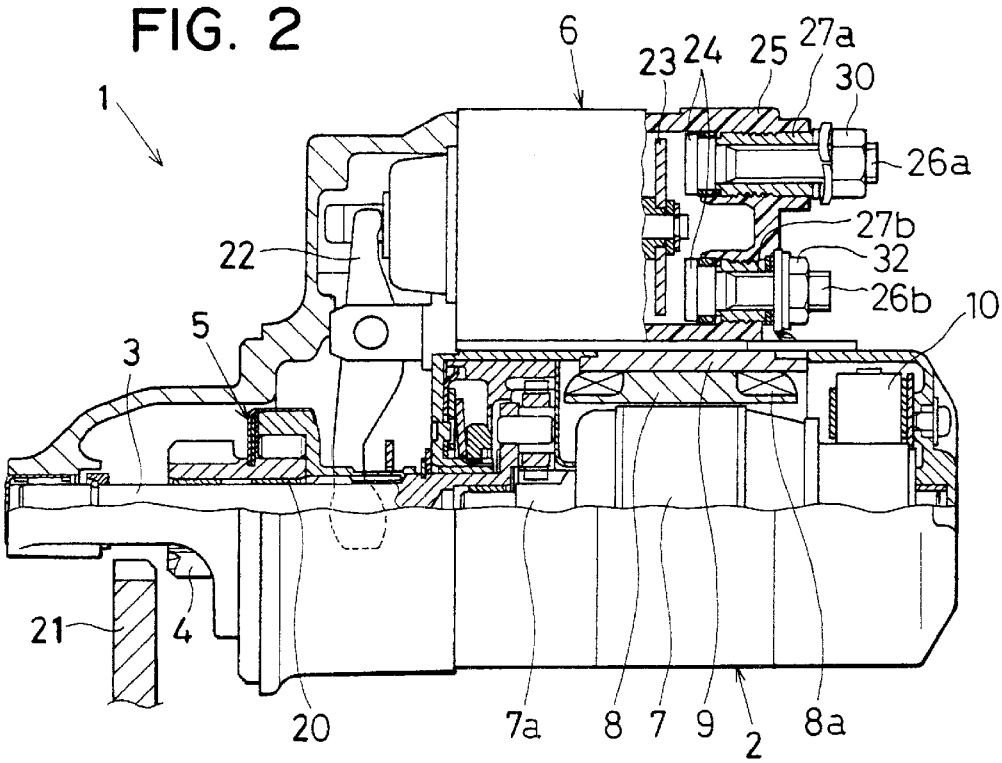
FIG. 2 is a longitudinal partly cross-sectional view of a starter with the magnet switch according to the first embodiment.

When a key switch is turned on and a coil (not shown) of magnet switch 6 is energized, the plunger is driven right in FIG. 2 so that lever 22 pushes pinion gear 4 together with one-way clutch 5 forward along output shaft 3. When the plunger moves and the pair of inner contacts of magnet switch 6 closes, armature 7 is energized and rotates. The rotation speed of armature 7 is reduced by the speed reduction unit and transmitted to output shaft 3.

The rotation of output shaft 3 is transmitted to pinion gear 4 via one-way clutch 5. When pinion gear 4 rotates and moves to a position to engage ring gear 21, the rotation of pinion gear 4 is transmitted to ring gear 21, thereby starting the engine.

When the key switch is turned off after the engine starts, the coil is no more energized and the plunger returns to the initial position. Accordingly, pinion gear 4, along with one-way clutch 5, separates from ring gear 21 and returns to the original position along output shaft 3. At the same time, the pair of inner contacts of magnet switch 6 opens to interrupt electric supply to armature 7. As a result, armature 7 stops rotation.

In magnet switch 6, O-ring 33*a* is pressed in the radial direction into a gap between cylindrical outer surface 263*ha* of neck portion 263*a* and cylindrical inner surface 25*ha* of switch cover 25 to there by seal both members. O-ring 33*b* is also mounted in the same manner as above. Thus, the sealing structure can be made simpler than the prior art described above, the number and the cost of sealing parts can be reduced.

Each of cylindrical members 27*a* and 27*b* has continuous corrugation surface 271*a* or 271*b*. This increases the length of the boundary between cylindrical member 27*a* or 27*b* and switch cover 25 so that water proofing magnet switch 6 can be provided. Moreover, corrugation surfaces 271*a* and 271*b* respectively prevent cylindrical members 27*a* and 27*b* from falling off switch cover 25.

Because O-rings 33*a* and 33*b* are fitted to cylindrical neck portion 263*a* and 263*b*, the inside diameter of O-rings 33*a* and 33*b* can be made enough larger than the outside diameter of screw portion 261*a* and 261*b*. This protects O-rings 33*a* and 33*b* from damage, when they are inserted through screw portion 261*a* or 261*b*.

Figure 4:
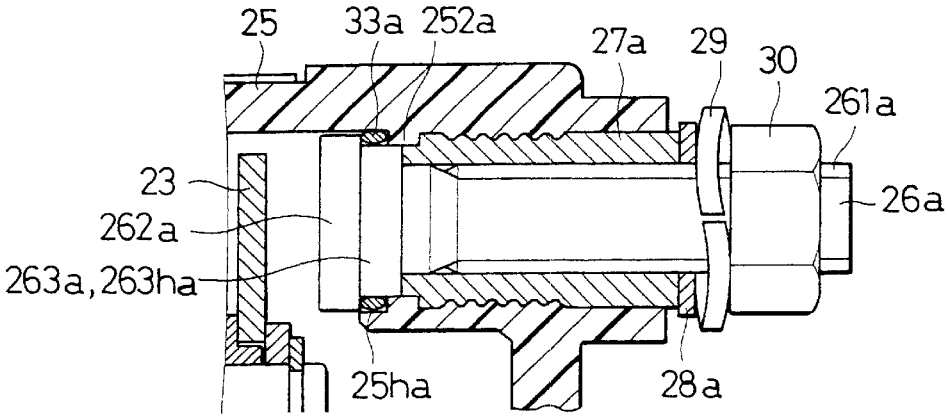
FIG. 4 is a cross-sectional view illustrating a seal structure around the external terminal of a magnet switch according to a second embodiment of the invention.

A magnet switch according to a second embodiment of the invention is described with reference to FIG. 4. O-ring 33*a* is radially pressed into the gap between cylindrical surface 263*ha* of neck portion 263*a* and cylindrical inner surface 25*ha* of switch cover 25 to seal the gap. Switch cover 25 is provided with centering inner cylindrical surface 252*a* so that cylindrical neck portion 263*a* can be fitted to it. Therefore, external terminal 26*a* can be directly centered without cylindrical member 27*a*, so that O-ring 33*a* can be pressed evenly over its circumference. This ensures good sealing performance.

Figure 5:
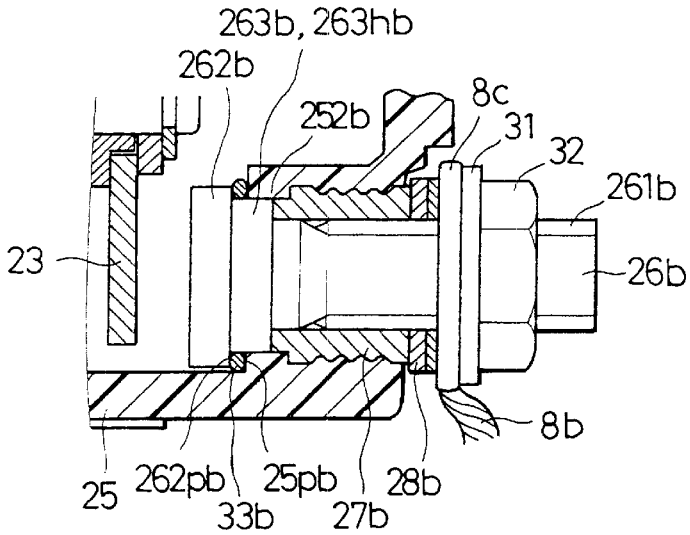
FIG. 5 is a cross-sectional view illustrating a seal structure around the external terminal of a magnet switch according to a third embodiment of the invention.

A magnet switch according to a third embodiment of the invention is described with reference to FIG. 5.

Cylindrical neck portion 263*b* of head portion 26*a* is fitted to centering inner cylindrical surface 252*b* of switch cover 25.

O-ring 33*b* is axially pressed into the gap between perpendicular surface 262*pb* formed between anchor portion 262*b* and cylindrical neck portion 263*b*, and axial end surface 25*pb* of switch cover 25.

Figure 6:
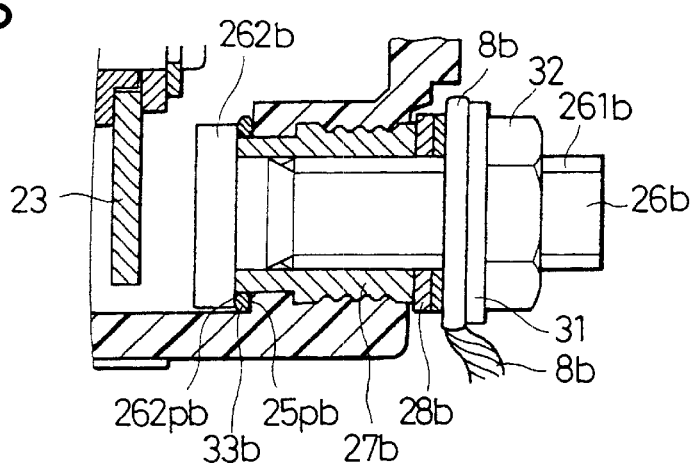
FIG. 6 is a cross-sectional view illustrating a seal structure around the external terminal of a magnet switch according to a fourth embodiment of the invention.

A magnet switch according to a fourth embodiment of the invention is described with reference to FIG. 6.

External terminal 26*b* has no cylindrical neck portion, and only head portion 262*b* is used for sealing.

Here, the axially inner or left end of cylindrical member 27*b* protrudes from the inner end of switch cover 25 and is supported by screw-side perpendicular surface 262*pb* of head portion 262*b*.

O-ring 33*b* is fitted to the outer periphery of cylindrical member 27*b* that protrudes from the inner end of switch cover 25. O-ring 33*b* is compressed between screw-side perpendicular surface 262*pb* and axial end surface 25*pb* of switch cover 25.

This sealing structure can also seal the inside of cylindrical member 27 and the outside waterproof surface at the same time.

As a variation, cup-shaped washer 28*b* can be substituted by a nut.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention is to be regarded in an illustrative, rather than a restrictive, sense.

What is claimed is:

1. A magnet switch comprising:

a resinous switch cover having a cylindrical metal member insert-molded into a fixing portion thereof;

an external terminal disposed inside said metal member, said terminal having a anchoring head having a first sealing surface at one end and a screw portion extending to the other end thereof, said the other end protruding from said switch cover;

a nut screwed to said screw portion at said the other end so as to generate an axial force between said nut and said anchoring head, thereby fixing said external terminal; wherein said switch cover has a second sealing surface opposite said anchoring head; and a seal member is disposed in a gap between said first sealing surface and said second sealing surface to seal said gap.

2. The magnet switch as claimed in claim 1, further comprising a cylindrical neck portion having a cylindrical outer periphery, wherein said anchoring head includes a rotation stopper portion having a polygonal outer periphery; and said cylindrical neck portion is formed stepwise at a side of said anchoring head facing said screw portion.

3. The magnet switch as claimed in claim 1, wherein an outer periphery of said cylindrical metal member has a corrugated surface in the longitudinal direction.

4. A magnet switch comprising:

a resinous switch cover having a cylindrical metal member insert-molded therein;

an external terminal having an anchoring head and a screw portion, said screw portion being inserted into the inside of said metal member from the inside of said switch cover;

fixing means screwed to a portion of said screw portion projecting from said switch cover so as to generate an axial force between said fixing means and said anchoring head, thereby fixing said external terminal; wherein said anchoring head has a first perpendicular surface that is approximately perpendicular to the axial direction at a side facing said screw portion;

said switch cover has a second perpendicular surface facing said first perpendicular surface of said head; and a seal member is disposed in a gap between said first and second perpendicular surfaces to seal said gap.

* * * * *